US010302079B2

(12) United States Patent
Kendrick

(10) Patent No.: US 10,302,079 B2
(45) Date of Patent: May 28, 2019

(54) METHODS AND SYSTEMS FOR ROUTING PRESSURIZED FLUID UTILIZING ARTICULATING ARMS

(71) Applicant: Halliburton Energy Services, Inc., Houston, TX (US)

(72) Inventor: William D. Kendrick, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/325,568

(22) PCT Filed: Aug. 12, 2014

(86) PCT No.: PCT/US2014/050697
§ 371 (c)(1),
(2) Date: Jan. 11, 2017

(87) PCT Pub. No.: WO2016/024952
PCT Pub. Date: Feb. 18, 2016

(65) Prior Publication Data

US 2017/0159654 A1 Jun. 8, 2017

(51) Int. Cl.

| | |
|---|---|
| ***F04B 53/16*** | (2006.01) |
| ***F04B 19/22*** | (2006.01) |
| ***E21B 43/26*** | (2006.01) |
| ***F04D 13/02*** | (2006.01) |
| ***F04D 13/12*** | (2006.01) |
| ***F04B 1/12*** | (2006.01) |

(52) U.S. Cl.
CPC ..... *F04B 53/16* (2013.01); *E21B 43/26* (2013.01); *F04B 1/12* (2013.01); *F04B 19/22* (2013.01); *F04D 13/02* (2013.01); *F04D 13/12* (2013.01); *Y10T 137/8807* (2015.04)

(58) Field of Classification Search
CPC .. F04B 53/16; F04B 19/22; F04B 1/12; E21B 43/26; Y10T 137/8807
USPC ..... 137/615; 141/387; 285/147.1, 147.3
See application file for complete search history.

(56) References Cited

U.S. PATENT DOCUMENTS 2,739,779 A 3/1956 Krone et al.
3,038,714 A 6/1962 Klaus et al.
(Continued)

FOREIGN PATENT DOCUMENTS

WO 2013/009274 A2 1/2013

OTHER PUBLICATIONS

International Search Report and Written Opinion issued in related PCT Application No. PCT/US2014/050697 dated May 6, 2015, 14 pages.

(Continued)

*Primary Examiner* — Kevin L Lee
(74) *Attorney, Agent, or Firm* — John W. Wustenberg; Baker Botts L.L.P.

(57) ABSTRACT

Systems and methods of routing pressurized fluid from a fluid source are disclosed. The system includes a composite articulating arm. The composite articulating arm further includes a first articulating arm and a second articulating arm. The first articulating arm and second articulating arm are coupled via a connection. The composite articulating arm of the disclosed system further includes no more than five elbows and six rotation points.

19 Claims, 4 Drawing Sheets

(56) References Cited

U.S. PATENT DOCUMENTS

| | | | | | |
|---|---|---|---|---|---|
| 3,114,392 | A | * | 12/1963 | Harper | B61C 17/02 137/343 |
| 3,458,167 | A | | 7/1969 | Cooley, Jr. | |
| 3,489,174 | A | | 1/1970 | Cooley, Jr. | |
| 3,724,499 | A | * | 4/1973 | Huniu | F15D 1/04 137/615 |
| 3,891,004 | A | | 6/1975 | Knight | |
| 4,232,710 | A | * | 11/1980 | Gallo et al. | B67D 9/02 137/615 |
| 4,408,943 | A | * | 10/1983 | McTamaney et al. | B63B 27/24 114/74 R |
| 4,570,673 | A | | 2/1986 | Kendrick et al. | |
| 4,653,554 | A | * | 3/1987 | Von Meyerinck et al. | B64F 1/28 137/615 |
| 6,701,980 | B2 | * | 3/2004 | Rothrock | B64F 1/28 137/615 |
| 8,590,556 | B2 | | 11/2013 | Kendrick | |
| 2007/0125544 | A1 | | 6/2007 | Robinson et al. | |
| 2010/0193057 | A1 | | 8/2010 | Garner et al. | |
| 2010/0313977 | A1 | * | 12/2010 | Sylard | B25J 9/1689 137/615 |
| 2011/0220228 | A1 | * | 9/2011 | Maini | B66C 23/64 137/615 |
| 2012/0060929 | A1 | | 3/2012 | Kendrick | |

OTHER PUBLICATIONS

International Preliminary Report on Patentability issued in related Application No. PCT/US2014/050697, dated Feb. 23, 2017 (11 pages).

* cited by examiner

METHODS AND SYSTEMS FOR ROUTING PRESSURIZED FLUID UTILIZING ARTICULATING ARMS

CROSS-REFERENCE TO RELATED APPLICATION

The present application is a U.S. National Stage Application of International Application No. PCT/US2014/050697 filed Aug. 12, 2014, which is incorporated herein by reference in its entirety for all purposes.

BACKGROUND

The present disclosure relates generally to well operations and, more particularly, to methods and systems for routing pressurized fluid utilizing a plurality of articulating arms.

In the production of oil and gas in the field, stimulation and treatment processes often involve mobile equipment that is set up and put in place at a work site. A large arrangement of various vehicles and equipment is typically required for well operations. The movement of equipment and personnel for assembly and disassembly can involve complex logistics. One aspect of well treatment operations typically involves the setup of one or more arrays of pumping modules. Pumping modules may be hauled to the work site by truck, and pinned, bolted or otherwise located together on the ground.

Pumping modules are often operatively connected to a manifold system, which may be a manifold trailer. The manifold system may be used at a relatively central location where stimulation fluid is prepared and pressurized and may interface with a blending module. The connections between the pumping modules and the other units typically involve an elaborate arrangement of tubular connections. Swivel joint assemblies, which may include a combination of rotation points, elbows and hammer union ends, and straight joints are often used to allow adjustment between fixed components. However, in many applications, the added weight and area required for these connections is disadvantageous.

The assembly and subsequent disassembly of the equipment for numerous pumping modules is time-consuming and highly labor-intensive. Moreover, there are inherent risks with each connection that is made and broken, including, but not limited to, hammer strike, tripping, back strain, pinch points, etc. It is therefore desirable to minimize health, safety and environmental risks associated with rigging up, rigging down, and operating multiple pieces of equipment and connections. It is also desirable to decrease the amount of time required to rig up and rig down manifold equipment from a pumping module to a manifold system.

BRIEF DESCRIPTION OF THE DRAWINGS

These drawings illustrate certain aspects of some of the embodiments of the present invention, and should not be used to limit or define the invention.

DESCRIPTION

Figure 1:
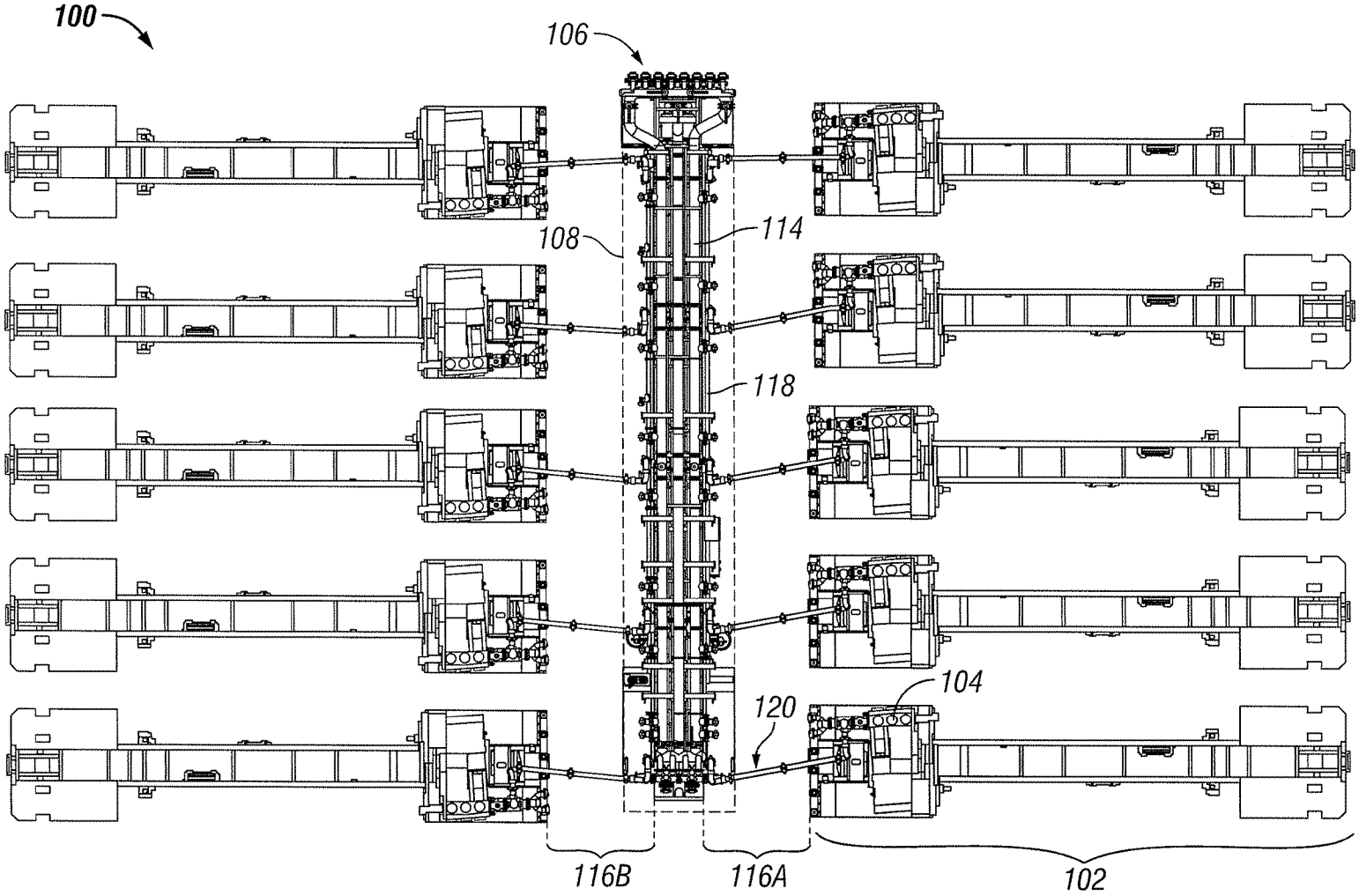
FIG. 1 illustrates a schematic plan view of one example pumping system with a manifold system, in accordance with certain embodiments of the present disclosure.

The present disclosure relates generally to well operations and, more particularly, to methods and systems for routing pressurized fluid utilizing a plurality of articulating arms.

Illustrative embodiments of the present disclosure are described in detail herein. In the interest of clarity, not all features of an actual implementation are described in this specification. It will of course be appreciated that in the development of any such actual embodiment, numerous implementation-specific decisions must be made to achieve developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of the present disclosure.

To facilitate a better understanding of the present disclosure, the following examples of certain embodiments are given. In no way should the following examples be read to limit, or define, the scope of the invention. Embodiments of the present disclosure may be applicable to horizontal, vertical, deviated, or otherwise nonlinear wellbores in any type of subterranean formation. Embodiments may be applicable to injection wells, monitoring wells, and production wells, including hydrocarbon or geothermal wells. Embodiments described below with respect to one implementation are not intended to be limiting. Further, it should be understood that applications in accordance with the present disclosure are not limited to pump-to-manifold or manifold-to-manifold applications, nor to oil field applications, stimulation operations, or fracturing operations. Rather, it should be understood that the applications in accordance with the present disclosure are applicable to any fluid conduit application that does not have perfect positioning between ends and/or requires relative movement between the ends after initial installation. As would be appreciated by one of ordinary skill in the art, relative movement between ends could include thermal expansion and contraction, substrate movements, and other position changes beyond those created by a reciprocating pump in the oil field.

The terms "couple" or "couples" as used herein are intended to mean either an indirect or a direct connection. Thus, if a first device couples to a second device, that connection may be through a direct connection, or through an indirect mechanical connection via other devices and connections.

Certain embodiments in accordance with the present disclosure provide for pumping systems for connecting fluid flow lines between pumping modules and other stationary and/or portable equipment. One purpose of pumping systems according to embodiments of this disclosure is to provide a flexible method of routing high-pressure and/or low-pressure fluid flow-lines for connecting pumping modules (either oscillating or stationary) to other stationary and/or portable equipment. The fluid flow-lines may be metallic, but may also be any non-metallic fluid flow-lines, including any rigid tubular fluid flow-lines, as would be appreciated by one of ordinary skill in the art. Another purpose of pumping systems according to embodiments of this disclosure is to allow the high-pressure and/or low-pressure fluid flow-lines to reach between a mobile pumping module and fixed-position unit without requiring precise relative positioning between the two units. Another purpose of the invention is to minimize human effort required in rigging up and rigging down and minimize human error associated with rigging up and rigging down by providing a conveniently positioned, low-effort, single-point make-and-break connection for the high-pressure and low-pressure fluid flow-lines. In certain embodiments, yet another purpose of pumping systems according to embodiments of this disclosure is to reduce health, safety, and/or environmental risks associated with rigging up, rigging down, and operating fluid delivery system equipment in various operations, including, but not limited to, fracturing or stimulation operations. For example, minimizing health and safety risks may be achieved by reducing lifting, carrying, and hammering during rig up and rig down. Another purpose of pumping systems according to embodiments of this disclosure is to provide value to customers or end-users by minimizing down time and job interruptions, while maximizing efficiency of rig up/rig down and maximizing reliability of operation. Each of these purposes may also contribute to an overall reduction in operating expenses.

Figure 2:
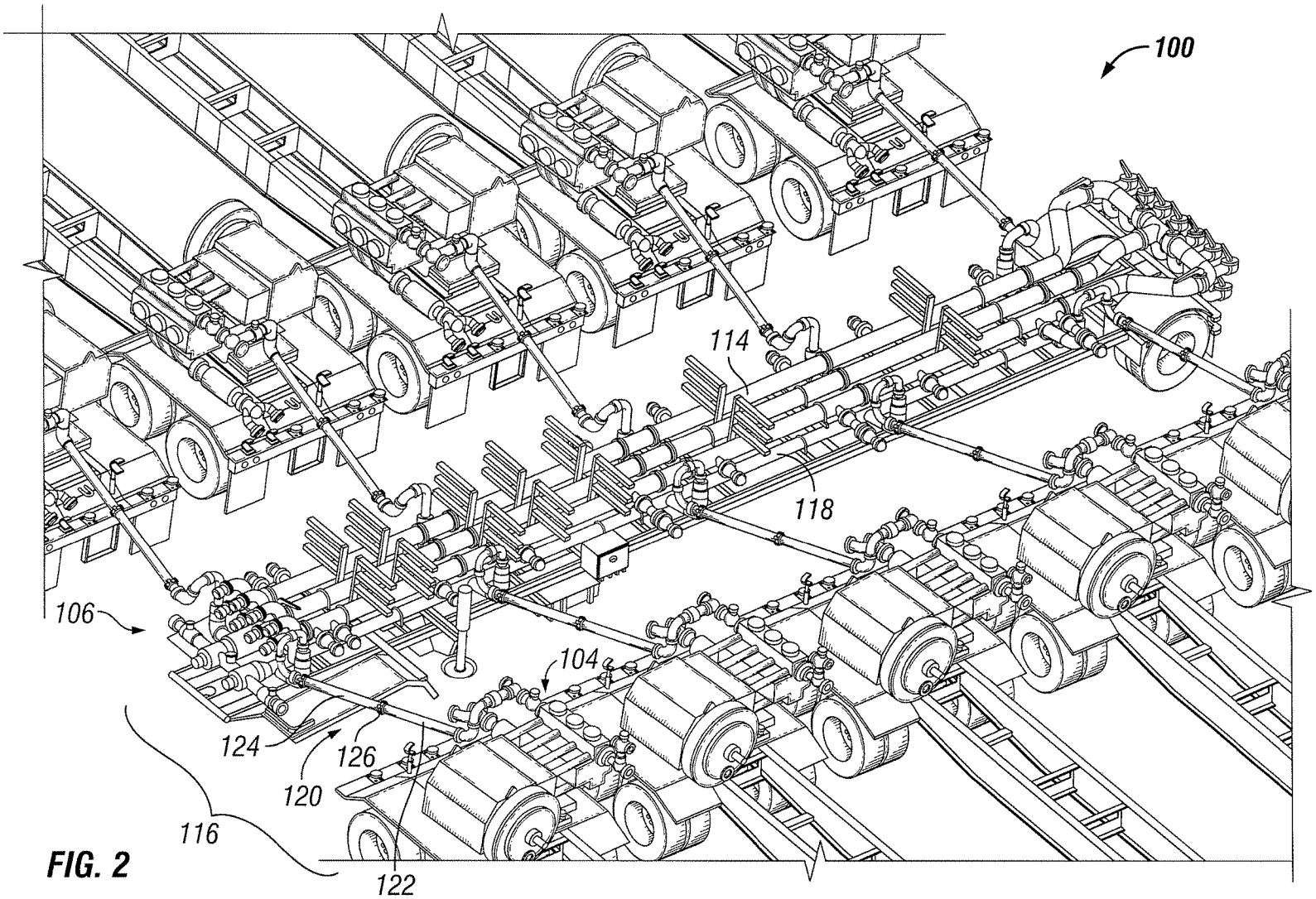
FIG. 2 illustrates a partial schematic perspective view of the example pumping system of FIG. 1, in accordance with certain embodiments of the present disclosure.

FIG. 1 illustrates a schematic plan view of one example pumping system 100 in accordance with certain embodiments of the present disclosure. The pumping system 100 may be configured for performing a well treatment operation, such as a hydraulic fracturing or stimulating operation. One or more pumping modules 102 may be employed to displace one or more volumes of fluid for an oilfield operation. As depicted, the pumping system 100 may include ten pumping modules 102 for fracturing operations. The pumping modules 102 may include positive displacement pumps 104, such as plunger pumps, or another type of pump, as would be appreciated by one of ordinary skill in the art. In certain embodiments, the pumping modules 102 may include pumps of a multiplex type, such as triplex, quintuplex, or another type of multiplex pump. The pump 104 may be mounted on a mobile trailer. One of ordinary skill in the art would understand that other elements, not shown in FIGS. 1 and 2, are typically associated with a pumping module that would include a pump such as the pump 104. For the sake of clarity, such other elements, such as engines and transmissions, are omitted from FIGS. 1 and 2. In certain embodiments, the pumping modules 102 may not all be of the same type. Although ten pumping modules are illustrated in FIG. 1, it should be understood that a different number of pumping modules may be utilized, as desired for various pumping situations. Over the course of an operation, the number of pumping modules in service may be changed depending on the specifics of the operation as, for example, when a pumping unit is brought off-line.

The pumping modules 102 may be coupled to a manifold system 106, which may be operable to accept pressurized stimulating fluid, fracturing fluid, or other well treatment fluid. The manifold system 106 may be deployed on a mobile manifold trailer 108 (an arrangement which is sometimes referenced in field operations as a missile or missile trailer) adapted to be moved by a motorized vehicle (not shown). In the alternative, the manifold system 106 may be self-propelled or skid-mounted. The manifold system 106 may be used at a central location where the fluid is prepared and pressurized.

The manifold system 106 may include a blending unit interface (not shown), which may be configured to receive fluid from one or more blending units (not shown). Further, the blending unit (not shown) may be coupled to a chemical storage system, a proppant storage system, and/or a water or other fluid (liquid or gas) source, and may prepare a fracturing fluid, with proppant and chemical additives or modifiers, by mixing and blending fluids and chemicals according to the needs of a well formation.

In certain embodiments, the pumping modules 102 may further include one or more pump interfaces 116A and 116B (collectively referenced by numeral 116). As depicted in FIG. 1, the pump interfaces 116 extend toward and may be coupled to pumps 104 on each side of the manifold system 106. Each of the pump interfaces 116 may be retractable with respect to the pump 104. In such a retracted position, the pump interfaces 116 may be suitably positioned and/or retracted for transport and/or storage.

In certain embodiments, the manifold system 106 may include one or more low-pressure main lines 114 and one or more high-pressure main lines 118 that extend along a length of the manifold system 106. The one or more low-pressure main lines 114 and one or more high-pressure main lines 118 may be coupled to pump interfaces 116. As illustrated in FIG. 1, each pump interface 116 may include a high-pressure articulating arm 120 configured for connecting a pump 104 to the one or more high-pressure main lines 118 in the manifold system 106. Each pump interface 116 may further include a low-pressure articulating arm (not shown) configured for connecting a pump 104 to the one or more low-pressure main lines 114 in the manifold system 106. The high-pressure articulating arm 120 and low-pressure articulating arm (not shown) may each include a first end and a second end. The high-pressure articulating arm 120 and low-pressure articulating arm (not shown) may fold in toward the manifold system 106 to a position suitable for storage and/or transport with the system.

Further, the one or more low-pressure main lines 114 may channel fluid to one or more pumps 104 through the low-pressure articulating arms (not shown). After receiving the fluid, a pump 104 may discharge the fluid at a relatively high pressure back to the high-pressure main line 118 through the high-pressure articulating arm 120. The fluid may then be directed toward a well bore. A line from the manifold system 106 may connect directly to a well head, or it may connect to intervening equipment such as a pump truck or another manifold system, depending on the particular implementation.

FIG. 2 illustrates a partial schematic perspective view of the example pumping system of FIG. 1, in accordance with certain embodiments of the present disclosure. The structure of an exemplary high-pressure articulating arm 120 will be discussed in conjunction with FIG. 2. Although certain exemplary systems are disclosed as utilizing a composite high-pressure articulating arm 120 with a particular structure (including a first articulating arm and second articulating arm, as explained herein), as would be appreciated by those of ordinary skill in the art having the benefit of the present disclosure, the disclosed embodiments are equally applicable to a low-pressure articulating arm (not shown), or other type of articulating arm, and may be applied in such a manner without departing from the scope of the present disclosure.

In certain embodiments, the high-pressure articulating arm 120 may include a first articulating arm 122 and a second articulating arm 124. Each of the first and second articulating arms 122, 124 may include a first end and a second end. The first articulating arm 122 may be coupled to the pump 104 at its first end and coupled to the second articulating arm 124 at its second end. The second articulating arm 124 may be coupled to the high-pressure main line 118 of the manifold system 106 at its first end and coupled to the first articulating arm 122 at its second end. The first articulating arm 122 and second articulating arm 124 may be coupled via a connection 126. In accordance with the present disclosure, the connection 126 may be a low-effort make-and-break connection. The make-and-break connection 126 may be a hammer union connection or any other type of connection suitable and known to one of ordinary skill in the art with the benefit of the present disclosure. In certain embodiments, when coupled, the first articulating arm 122 and the second articulating arm 124 together may form the composite high-pressure articulating arm 120. Further, as would be appreciated by one of ordinary skill in the art with the benefit of the present disclosure, the first and second ends of the first articulating arm 122, second articulating arm 124, and high-pressure articulating arm 120 may be structurally supported by the manifold system 106, and thus the force and labor required to move and position the arms may be minimized.

The first articulating arm 122 and second articulating arm 124 may each include high-capacity, lightweight couplings, such as swivel joints assemblies, which may include elbows, rotation points, and end connections, including hammer union ends. The components of the first articulating arm 122 and second articulating arm 124 may be assembled prior to transportation of the pumping system 100 to the job site. The swivel joint assemblies of the first articulating arm 122 and second articulating arm 124 may allow the lines of the pumping system 100 to conform to the dimensions and layout of the job site without the added steps of separating and reconnecting the components of the first articulating arm 122 and second articulating arm 124. The pumping system 100 may be rigged up and rigged down without any separating or reconnecting of the components of the lines, with the exception of the make-or-break connection between the first articulating arm 122 and second articulating arm 124. This may, thereby, minimize on-site labor, time, and opportunities for injury. In some instances, it may be beneficial to assemble or disassemble components of the pumping system 100 at the job site.

Further, one or more swivel joint assemblies may allow for adjustable right/left orientations of the pump interfaces 116. In certain embodiments, pump interfaces 116 may include various right and left orientation that may facilitate arrangement of, and connection to, the pumping modules 102 and pumps 104. Additionally, the swivel joint assemblies may allow for adjustable extension and retraction between the manifold system 106 and the pumping modules 102 and pumps 104. The swivel joint assemblies may be adjustable to accommodate equipment connections in spite of parking misalignment to the left or right, for example. For example, such features may facilitate the parking of multiple pumping units in generally symmetrical and/or evenly spaced manner. The swivel joint assemblies may be adjustable to accommodate variations in elevations and angles of the equipment. Further, the swivel joint assemblies may accommodate movement of the pumping modules 102 and/or pumps 104 that may occur during operations. Further still, the swivel joint assemblies may reduce the weight that workers would need to lift during set-up and take-down, thereby providing the benefit of ease of installation.

The details of exemplary embodiments of composite articulating arm, first articulating arm and second articulating arm will be described in further detail herein with reference to FIGS. 3-5.

Figure 3:
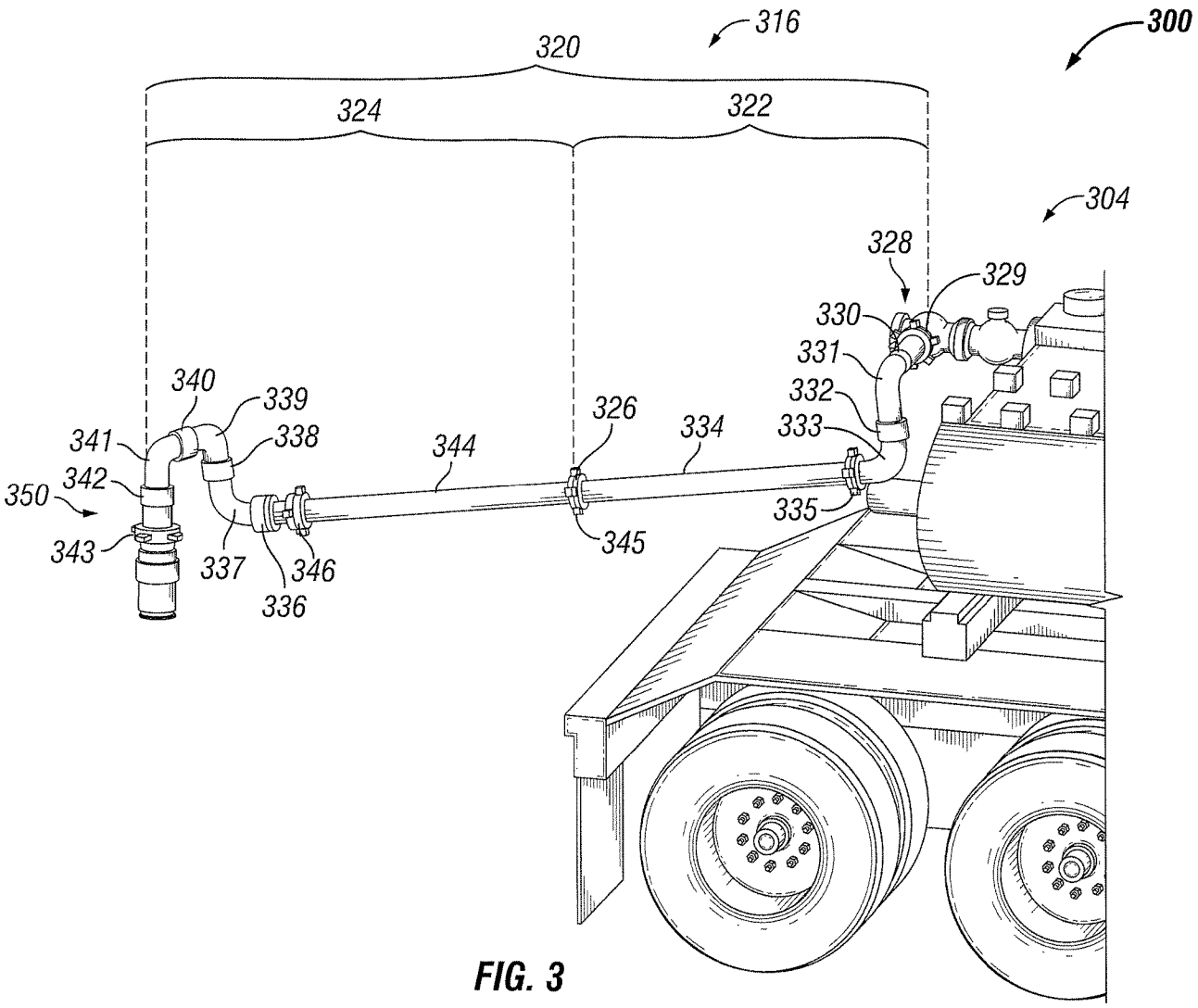
FIG. 3 illustrates a schematic perspective view of one exemplary pump interface of a pumping system, in accordance with certain embodiments of the present disclosure.

FIG. 3 illustrates a schematic perspective view of one exemplary pump interface 316 of a pumping system 300, in accordance with certain embodiments of the present disclosure. In the illustrative embodiment shown in FIG. 3, a pump interface 316 may include a high-pressure composite articulating arm 320 configured for connecting a pump 304 to one or more high-pressure main lines (not shown) in a manifold system (not shown). The high-pressure composite articulating arm 320 may include a first articulating arm 322 and second articulating arm 324. The high-pressure articulating arm 320 (i.e., the first articulating arm 322 and second articulating arm 324) may further include five elbows and six rotation points.

As illustrated in FIG. 3, the first articulating arm 322 may be coupled to the pump 304, and the second articulating arm 324 may be coupled to a high-pressure main line in a manifold system (not shown). In certain embodiments, the first articulating arm 322 may include a swivel joint assembly 328. The swivel joint assembly 328 may further include two rotational points 330 and 332, two elbows 331 and 333, and two end connections 329 and 335. In certain embodiments, the end connections 329 and 335 may include a hammer union connection or any other type of connection suitable and known to one of ordinary skill in the art with the benefit of the present disclosure. The swivel joint assembly 328 may be coupled to the pump 304 via end connection 329. Elbow 331 and elbow 333 may be joined together and fitted with rotation point 332, which may be configured to allow for rotational positioning of elbow 333 relative to the elbow 331. The first articulating arm 322 may further include an extension 334. As would be appreciated by one of ordinary skill in the art with the benefit of the present disclosure, the extension 334 may not be necessary in all applications in accordance with the present disclosure. The extension 334 may be coupled at one end to the swivel joint assembly 328 via end connection 335. The extension 334 may include at its other end an end connection 345. In certain embodiments, the end connection 345 may include a hammer union connection or any other type of connection suitable and known to one of ordinary skill in the art with the benefit of the present disclosure. It should be understood that the first articulating arm 322 may be adjustable so that a wider range of adjustment than that shown in FIG. 3 is contemplated.

As further illustrated in FIG. 3, the second articulating arm 324 may be coupled to a manifold system (not shown). In certain embodiments in accordance with this illustrative embodiment, the second articulating arm 324 may include a swivel joint assembly 350. The swivel joint assembly 350 may further include four rotation points 336, 338, 340, and 342, three elbows 337, 339, and 341, and two end connections 343 and 346. In certain embodiments, the end connections 343 and 346 may include a hammer union connection or any other type of connection suitable and known to one of ordinary skill in the art with the benefit of the present disclosure. The swivel joint assembly 350 may be coupled to a manifold system (not shown) via hammer union end 343. Elbow 339 and elbow 341 may be joined together and fitted with rotation point 340, which may be configured to allow for rotational positioning of elbow 339 relative to the elbow 341. Elbow 337 and elbow 339 may be joined together and fitted with rotation point 338, which may be configured to allow for rotational positioning of elbow 337 relative to the elbow 339. The second articulating arm 324 may further include an extension 344. As would be appreciated by one of ordinary skill in the art with the benefit of the present disclosure, the extension 344 may not be necessary in all applications in accordance with the present disclosure. The extension 344 may be coupled at one end to the swivel joint assembly 350 via end connection 346. The extension 344 may include at its other end an end connection, or as illustrated in FIG. 3, may be configured to allow connection with an end connection of the first articulating arm 322. It should be understood that the second articulating arm 324 may be adjustable so that a wider range of adjustment than that shown in FIG. 3 is contemplated.

As would be appreciated by one of ordinary skill in the art with the benefit of the present disclosure, in certain embodiments, an axis of elbow 341 and an axis of elbow 339 may be in substantially the same plane. In certain embodiments, an axis of elbow 337 may be in a plane substantially perpendicular to that of elbow 341 and elbow 339. This may act like a "bell-crank" that may enable the second articulating arm 324 to be extended both forward and backward from a neutral position or otherwise moveable as would be appreciated by one of ordinary skill in the art. Further, in certain embodiments, an axis of elbow 331 and an axis of elbow 333 may be in substantially perpendicular planes. As would be appreciated by one of ordinary skill in the art, the phrase "substantially perpendicular planes" may include planes that are not entirely perpendicular. For example, two planes that are more nearly perpendicular than parallel with each other may be considered "substantially perpendicular planes" in accordance with the present disclosure.

Further, in certain embodiments in accordance with this illustrative embodiment, the composite high-pressure articulating arm 320 may include a first end and a second end. In the illustrative embodiments shown in FIG. 3, the first end may be coupled to the pump, and the second end may be coupled to the manifold system. In certain embodiments in accordance with the present disclosure, an axis of the elbow nearest the first end of the composite high-pressure articulating arm 320 (i.e., elbow 331 of swivel joint assembly 328 of the first articulating arm 322) may be in a substantially parallel plane as the axes of the two elbows nearest the second end of the composite high-pressure articulating arm 320 (i.e., elbow 341 and elbow 339 of swivel joint assembly 350 of the second articulating arm 324). As would be appreciated by one of ordinary skill in the art, the phrase "substantially parallel planes" may include planes that are not entirely parallel. For example, two planes that are more nearly parallel than perpendicular with each other may be considered "substantially parallel planes" in accordance with the present disclosure. In certain embodiments, two planes that are 30 degrees out of parallel with each other may be considered "substantially parallel planes" in accordance with the present disclosure.

Further, as would further be appreciated by one of ordinary skill in the art with the benefit of the present disclosure, in certain embodiments, swivel joint assembly 328 may include three rotational points instead of two rotation points, and swivel joint assembly 350 may include three rotation points instead of four rotation points. In this embodiment, for example, a rotation point located along a same axis as the connection 326 (in FIG. 3, rotation point 336 of swivel joint assembly 350 of the second articulating arm 324) may instead be part of the pump-side swivel joint assembly 328 of the first articulating arm 322. For example, rotation point 336 may be removed, and a rotation point may instead be located between elbow 333 and end connection 335. Further, the rotation point located along a same axis as the connection 326 may be included as part of an additional swivel joint assembly (not shown) in either of the first or second articulating arms, so long as the rotation point is located along the same axis as the connection 326. In this embodiment, the high-pressure composite articulating arm 320 (i.e., the first articulating arm 322 and second articulating arm 324) may still include five elbows and six rotation points.

Figure 4:
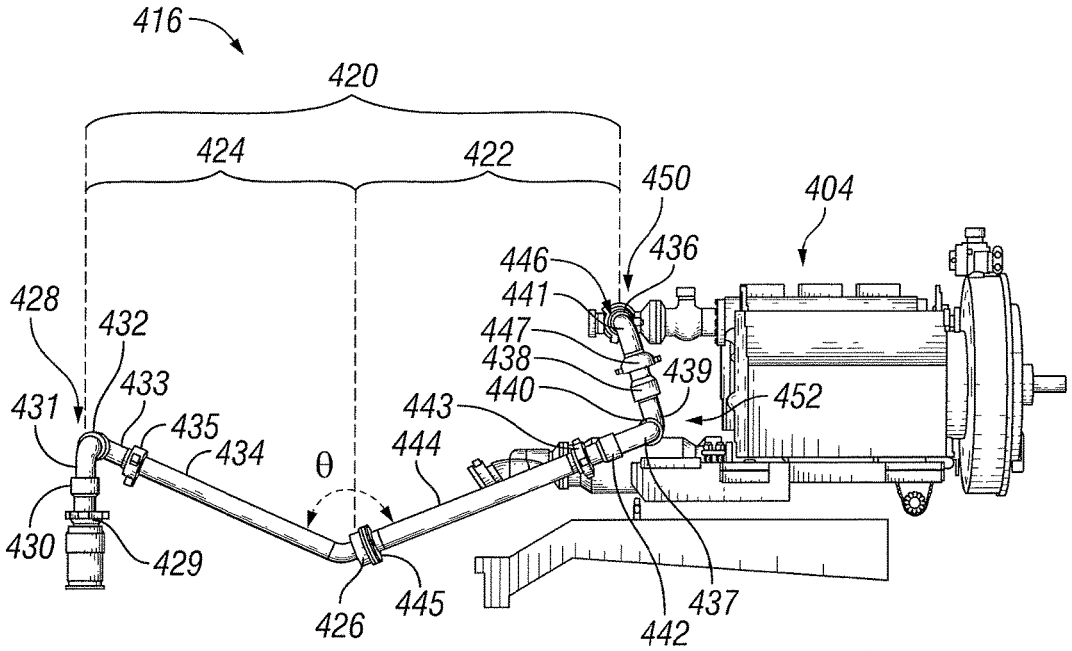
FIG. 4 illustrates a schematic perspective view of a second exemplary pump interface of a pumping system, in accordance with certain embodiments of the present disclosure.

FIG. 4 illustrates a schematic perspective view of a second exemplary pump interface of a pumping system, in accordance with certain embodiments of the present disclosure. As with FIG. 3, the pump interface 416 may include a high-pressure composite articulating arm 420 configured for connecting a pump 404 to one or more high-pressure main lines (not shown) in a manifold system (not shown). The high-pressure articulating arm 420 may include a first articulating arm 422 and second articulating arm 424, and may further include five elbows and six rotation points.

As illustrated in FIG. 4, the first articulating arm 422 may be coupled to the pump 404, and the second articulating arm 424 may be coupled to a high-pressure main line in a manifold system (not shown). In certain embodiments in accordance with this illustrative embodiment, the first articulating arm 422 may include two swivel joint assemblies 450 and 452. Swivel joint assembly 450 may further include one rotation point 436, one elbow 441, and one end connection 446. In certain embodiments, the end connection 446 may include a hammer union connection or any other type of connection suitable and known to one of ordinary skill in the art with the benefit of the present disclosure. Swivel joint assembly 450 may be coupled to pump 404 via end connection 446. Elbow 441 may be fitted with rotation point 436. Swivel joint assembly 452 may include three rotation points 438, 440, and 442, two elbows 439 and 437, and two end connections 447 and 443. In certain embodiments, the end connections 447 and 443 may include a hammer union connection or any other type of connection suitable and known to one of ordinary skill in the art with the benefit of the present disclosure. Swivel joint assembly 450 may be coupled to swivel joint assembly 452 via end connection 447. Elbow 439 and elbow 437 may be joined together and fitted with rotation point 440, which may be configured to allow for rotational positioning of elbow 439 relative to the elbow 437. The first articulating arm 422 may further include an extension 444. As would be appreciated by one of ordinary skill in the art with the benefit of the present disclosure, the extension 444 may not be necessary in all applications in accordance with the present disclosure. The extension 444 may be coupled at one end to the swivel joint assembly 452 via end connection 443. The extension 444 may include at its other end an end connection 445. In certain embodiments, the end connection 445 may include a hammer union connection or any other type of connection suitable and known to one of ordinary skill in the art with the benefit of the present disclosure. It should be understood that the first articulating arm 422 may be adjustable so that a wider range of adjustment than that shown in FIG. 4 is contemplated.

As further illustrated in FIG. 4, the second articulating 424 may include a swivel joint assembly 428. The swivel joint assembly 428 may further include two rotational points 430 and 432, two elbows 431 and 433, and one end connection 429. In certain embodiments, the end connection 429 may include a hammer union connection or any other type of connection suitable and known to one of ordinary skill in the art with the benefit of the present disclosure. The swivel joint assembly 428 may be coupled to the manifold system (not shown) via end connection 429. Elbow 431 and elbow 433 may be joined together and fitted with rotation point 432, which may be configured to allow for rotational positioning of elbow 433 relative to the elbow 431. The second articulating arm 422 may further include an extension 434. As would be appreciated by one of ordinary skill in the art with the benefit of the present disclosure, the extension 434 may not be necessary in all applications in accordance with the present disclosure. The extension 434 may include an end connection 435 and may be coupled to the swivel joint assembly 428 via end connection 435. In certain embodiments, the end connection 435 may include a hammer union connection or any other type of connection suitable and known to one of ordinary skill in the art with the benefit of the present disclosure. The extension 434 may include at its other end an end connection, or as illustrated in FIG. 4, may be configured to allow connection with an end connection of the first articulating arm 422. It should be understood that the second articulating arm 424 may be adjustable so that a wider range of adjustment than that shown in FIG. 4 is contemplated.

Figure 5:
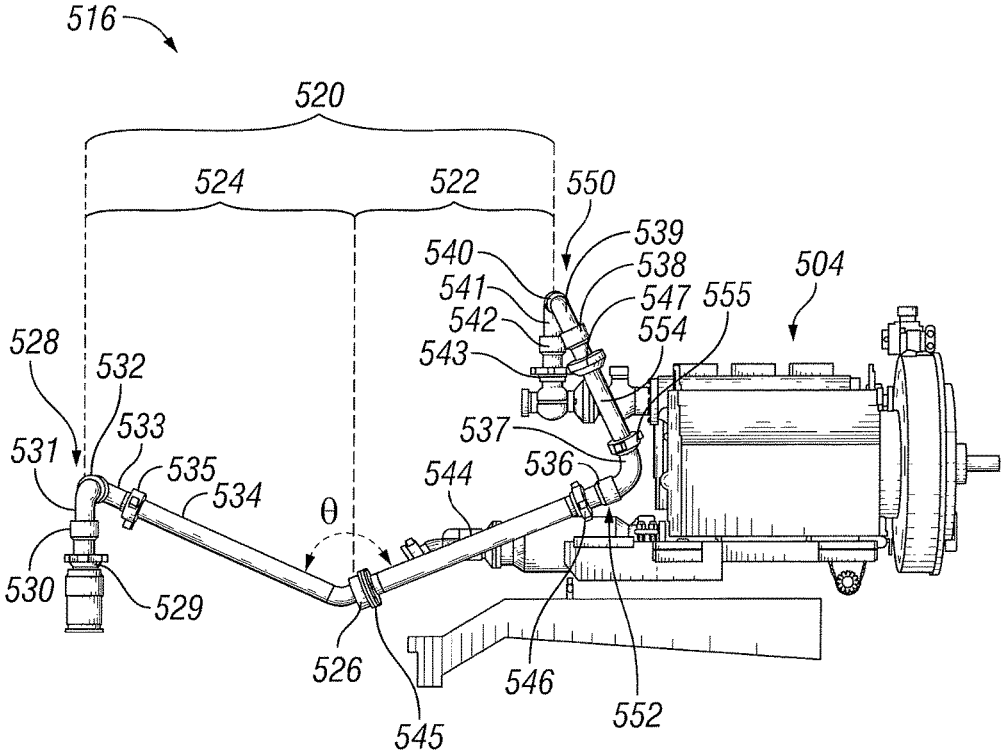
FIG. 5 illustrates a schematic perspective view of a third exemplary pump interface of a pumping system, in accordance with certain embodiments of the present disclosure.

FIG. 5 illustrates a schematic perspective view of a third exemplary pump interface of a pumping system, in accordance with certain embodiments of the present disclosure. As with FIGS. 3 and 4, the pump interface 516 may include a high-pressure composite articulating arm 520 configured for connecting a pump 504 to one or more high-pressure main lines (not shown) in a manifold system (not shown). The high-pressure articulating arm 520 may include a first articulating arm 522 and second articulating arm 524, and may further include five elbows and six rotation points. As illustrated in FIG. 5, the first articulating arm 522 may be coupled to the pump 504, and the second articulating arm 524 may be coupled to a high-pressure main line in a manifold system (not shown). As shown in FIG. 5, the second articulating arm 524 has an identical structure to that described with respect to FIG. 4. That is, the second articulating arm 524 may include a swivel joint assembly 528, and the swivel joint assembly 528 may further include two rotational points 530 and 532, two elbows 531 and 533, and one end connection 529. The detailed description of the second articulating arm 424 in FIG. 4 is equally applicable to the second articulating arm 524 in FIG. 5.

FIG. 5 illustrates yet another embodiment of the first articulating arm 522. In certain embodiments in accordance with this illustrative embodiment, the first articulating arm 522 may include two swivel joint assemblies 550 and 552 and a straight joint 554. Swivel joint assembly 550 may further include three rotation points 538, 540, and 542, two elbows 539 and 541, and two end connections 543 and 547. In certain embodiments, the end connections 543 and 547 may include a hammer union connection or any other type of connection suitable and known to one of ordinary skill in the art with the benefit of the present disclosure. Elbow 539 and elbow 541 may be joined together and fitted with rotation point 540, which may be configured to allow for rotational positioning of elbow 539 relative to the elbow 541. Swivel joint assembly 550 may be coupled to the pump 504 via end connection 543. Swivel joint assembly 550 may be coupled to straight joint 554 via end connection 547. Straight joint 554 may include an end connection 555. In certain embodiments, the end connection 555 may include a hammer union connection or any other type of connection suitable and known to one of ordinary skill in the art with the benefit of the present disclosure. Swivel joint assembly 552 may include one rotation point 536, one elbow 537, and one end connection 546. In certain embodiments, the end connection 546 may include a hammer union connection or any other type of connection suitable and known to one of ordinary skill in the art with the benefit of the present disclosure. Elbow 537 may be fitted with rotation point 536. The first articulating arm 522 may further include an extension 544. As would be appreciated by one of ordinary skill in the art with the benefit of the present disclosure, the extension 544 may not be necessary in all applications in accordance with the present disclosure. The extension 544 may be coupled at one end to the swivel joint assembly 552 via end connection 546. The extension 544 may include at its other end an end connection 545. In certain embodiments, the end connection 545 may include a hammer union connection or any other type of connection suitable and known to one of ordinary skill in the art with the benefit of the present disclosure. It should be understood that the first articulating arm 522 may be adjustable so that a wider range of adjustment than that shown in FIG. 5 is contemplated.

Referring to FIGS. 3-5, as would be appreciated by one of ordinary skill in the art with the benefit of the present disclosure, the first articulating arm 322, 422, 522 and second articulating arm 324, 424, 524 may be coupled via a connection 326, 426, 526. In accordance with the present disclosure, the connection 326, 426, 526 may be a low-effort make-and-break connection. The make-and-break connection 326, 426, 526 in accordance with the present disclosure may be configured to allow one person to connect the first articulating min 322, 422, 522 and second articulating arm 324, 424, 524 if a method of manual connection is utilized. As previously explained, once coupled, the first articulating arm 322, 422, 522 and second articulating arm 324, 424, 524 form one composite high-pressure articulating arm 320, 420, 520.

As would be appreciated by one of ordinary skill in the art with the benefit of the present disclosure, in certain embodiments, an axis of elbow 441, 541 and an axis of elbow 439, 539 may be in substantially the same plane. In certain embodiments, an axis of elbow 437, 537 may be in a plane substantially perpendicular to that of elbow 441, 541 and elbow 439, 539. As explained with reference to FIG. 3, this "bell-crank" feature may enable the first articulating arm 422, 522 to be extended both forward and backward from a neutral position or otherwise moveable as would be appreciated by one of ordinary skill in the art. Further, in certain embodiments, an axis of elbow 431, 531 and an axis of elbow 433, 533 may be in substantially perpendicular planes. As would be appreciated by one of ordinary skill in the art, the phrase "substantially perpendicular planes" may include planes that are not entirely perpendicular. For example, two planes that are more nearly perpendicular than parallel with each other may be considered "substantially perpendicular planes" in accordance with the present disclosure.

Further, as would be appreciated by one of ordinary skill in the art, the composite high-pressure articulating arm 420, 520 may further include a first end and a second end. As explained with reference to FIG. 3, the first end may be coupled to the pump, and the second end may be coupled to the manifold system. In certain embodiments in accordance with the present disclosure, an axis of the elbow nearest the second end of the composite high-pressure articulating arm 420, 520 (i.e., elbow 431, 531 of swivel joint assembly 428, 528 of the second articulating arm 424, 524) may be in a substantially parallel plane as the axes of the two elbows nearest the first end of the composite high-pressure articulating arm 420, 520 (i.e., elbow 441, 541 and elbow 439, 539 of swivel joint assemblies 450, 452, 550 of the first articulating arm 422, 522). As would be appreciated by one of ordinary skill in the art, the phrase "substantially parallel planes" may include planes that are not entirely parallel. For example, two planes that are more nearly parallel than perpendicular with each other may be considered "substantially parallel planes" in accordance with the present disclosure. In certain embodiments, two planes that are 30 degrees out of parallel with each other may be considered "substantially parallel planes" in accordance with the present disclosure.

As would be appreciated by one of ordinary skill in the art with the benefit of the present disclosure, FIGS. 3-5 merely illustrates certain degrees of freedom about the rotation points of the first articulating arm 322, 422, and 522 and the rotation points of the second articulating arm 324, 424, 524, whereas additional rotation points may be added and/or exchanged between the first and second articulating arms to provide additional rotation points and corresponding degrees of freedom not depicted. In certain embodiments in accordance with the present disclosure, however, the number of rotation points in both the first articulating arm 322, 422, and 522 and second articulating arm 324, 424, 524 may not exceed six total, and the number of elbows in both the first and second articulating arms may not exceed five total.

Further, referring back to FIGS. 4 and 5, in certain embodiments, a rotation point located along a same axis as any of extension 434, 534, 444, 544 (in FIG. 4, rotation point 442 of swivel joint assembly 452 of the first articulating arm 422, and in FIG. 5, rotation point 536 of swivel joint assembly 552 of the first articulating arm 522) may be included as part of an additional swivel joint assembly (not shown) in either of the first or second articulating arms, so long as the rotation point is located along the same axis as any of extension 434, 534, 444, 544. In this embodiment, the high-pressure composite articulating arm 420, 520 (i.e., the first articulating arm 422, 522 and second articulating arm 424, 524) may still include five elbows and six rotation points.

Further, as illustrated in FIGS. 4 and 5, in certain embodiments in accordance with the present disclosure, the composite articulating arm 420, 520 may include one or more angle θ deviations. As would be appreciated by one of ordinary skill in the art, one or more angle θ deviations may be located at anywhere along the composite articulating arm 420, 520, including as part of either or both of the first articulating arm 422, 522 and the second articulating arm 424, 524, including as part of the swivel joint assemblies. In accordance with certain embodiments of the present disclosure, the angle θ may be any suitable angle known to those of skill in the art that enhances the positioning of any coupling by changing the relationship of the faces of that coupling. In certain illustrative embodiments, angle θ may be located at the end of extension 434, 534 closest to the make-and-break connection 426, 526. As would be appreciated by one of ordinary skill in the art with the benefit of the present disclosure, the θ angle may be any suitable angle that may allow the make-and-break connection 426, 526 to be closer to the ground, which may allow for easier assembly and disassembly. For example, the θ may be a 45 degree deviation from straight (or a 135 degree angle between extension 434, 534 and extension 444, 544). In this manner, the first articulating arm 422, 522 may be adjustable to provide a downward slope from the pump 404, 504 (or the second articulating arm 424, 524 adjusted to provide a downward slope from the manifold system (not shown)) that may allow the high-pressure articulating arm 420, 520 to be closer to the ground, which may allow for easier assembly and disassembly.

Although the θ is illustrated in FIGS. 4 and 5 as being part of the extension 434, 534 of the second articulating arm 424, 524 it should be understood that the θ may be included at the end connection 445 of the extension 444, 544 of the first articulating arm 422, 522, or at any point along the composite articulating arm 420, 520, as desired for various pumping situations. It should further be appreciated by one of ordinary skill in the art with the benefit of the present disclosure, that the embodiments illustrated in FIGS. 4 and 5 may not include an angle θ as part of the extension 434, 534, or anywhere along the composite articulating arm 420, 520. Rather, the extension 434, 534 may be a straight segment as that illustrated in FIG. 3. It should be understood that the embodiments described herein are not intended to be limiting.

Further, the embodiments illustrated in FIGS. 4 and 5 and described herein may also achieve a lower height for the make-and-break connections by positioning the majority of the rotation points close to the pump-end. FIG. 5 further illustrates one method of achieving a lower height for the make-and-break connections by utilizing a straight joint 554. The arrangements illustrated in FIGS. 4 and 5 isolate the movement and acceleration of the high-pressure composite articulating arm 420, 520 closer to the pump-end and reduce the possibility of creating a resonance condition in the extensions 434, 534, 444, 544. These arrangements further reduce the risk of damage to and breakage of the high-pressure composite articulating arm 420, 520, including the first articulating arm and second articulating arm.

As would be understood by one of ordinary skill in the art with the benefit of this disclosure, various methods of routing pressurized fluid from a fluid source are provided. In one embodiment, a method in accordance with the present disclosure includes the step of providing one or more pumping modules. As described above, each of the pumping modules may include a pump and a pump interface, and the pump interface may include a composite articulating arm. The composite articulating arm may further include a first articulating arm and a second articulating arm. The method may further include the step of providing a manifold system comprising a high-pressure main line and a low-pressure main line. As would be appreciated by one of skill in the art, the high-pressure main line may be configured to accept a pressurized fluid from the pump by way of a composite articulating arm. Similarly, the low-pressure main line may be configured to supply a pressurized fluid from a fluid source to the pump by way of a composite articulating arm. The method may further include the steps of coupling the first articulating arm to the pump and the second articulating arm to a manifold system, and coupling the first articulating arm to the second articulating arm to form a composite articulating arm. In accordance with certain embodiments of the present disclosure, the method may further include the step of routing a pressurized fluid from a fluid source via the composite articulating arm.

Certain embodiments of this disclosure help to minimize health, safety and environmental risks associated with rigging up, rigging down, and operating multiple pieces of pumping and manifold equipment and connections. For example, minimizing health and safety risks may be achieved by reducing lifting, carrying, and hammering during rig up and rig down. The number of connections typically required for well treatment operations, such as fracturing or stimulation operations, may be reduced. This reduces the inherent risks with each connection that is made and broken, including but not limited to hammer strike, tripping, back strain, pinch points, etc. Each of these benefits contributes to a reduction in operating expenses.

Further, certain embodiments may allow the assembly and subsequent disassembly of the equipment for numerous pumping modules to be more efficient, less time-consuming, and less labor-intensive. Specifically, unlike traditional methods, this method does not require, and in fact, does not allow any segment of each of the articulating arms to touch the ground. This assures that the components will stay cleaner, which may enhance the assembly of the components and improve the reliability of sealing. Certain embodiments in accordance with the present disclosure may also reduce the risk of back injury while operators are bent low and may eliminate potential equipment damages from component-to-ground impact at highly acute angles. Moreover, certain embodiments in accordance with the present disclosure provide for the pump-end first articulating arm to be counterbalanced, thus decreasing the lifting requirements of the operator responsible for making and breaking the connection between the first articulating arm and second articulating arm. This also reduces the need for a mechanical-lift assist mechanism, although it should be appreciated by one of ordinary skill in the art that certain embodiments in accordance with the present disclosure may include mechanical-lift features on either or both ends of the composite articulating arm to further reduce the lifting effort required of the operator responsible for making and breaking the connection between the first articulating arm and second articulating arm.

Moreover, conventional systems typically require many hoses, swivels (i.e., rotation points), elbows, and straight joints, each of which requires multiple action steps for rig up and rig down. In addition, hammer unions are often required, adding to the difficulty. For example, each hose may require unloading, carrying, attaching a wing end, attaching a thread end, detaching the thread end, detaching the wing end, carrying, and loading. Each of the action steps is an opportunity for injury and is time-consuming. Over the course of a rig up and rig down of a complete system, the aggregate of the action steps results in many opportunities for injury and significant time and expense. In contrast, certain embodiments of this disclosure provide a pumping system that would replace the many individually transported, installed, and uninstalled hoses, swivels, and straight joints with low- and/or high-pressure composite articulating arms (comprised of first and second articulating arms) that have adequate flexibility to accommodate the variability of equipment positioning, vibration and other movement. Specifically, the composite articulating arm described herein may include a first articulating arm and second articulating arm and may further include no more than five elbows and six rotation points.

Further, methods and systems in accordance with the present disclosure may provide better system reliability due to the fewer components and connections required. In addition, human effort required in rigging up and rigging down may be minimized by providing a conveniently positioned, low-effort, single-point make-and-break connection for the high-pressure and low-pressure fluid flow-lines. In certain embodiments, the low- and high-pressure composite articulating arms may be configured to swing out toward the pumping modules. In accordance with certain embodiments disclosed herein, the pump-end of the pumping system may rotate downward and forward (i.e., towards the pump) during rig down between operations for stowing in the road position. This feature may reduce the lifting effort by favorably shifting the center of gravity of the first articulating arm and eliminate the need to rotate the unattached end of the first articulating arm for stowing in an advantageous road position. The risk of human error may also be minimized because, for example, each of the first and second articulating arms remains attached to its respective unit (i.e., pump and/or manifold), fully assembled, and easily rotated into transporting position as part of the rig down procedure. Further, each of the benefits described herein may reduce rig up and rig down time and thus provide for more efficient and time-saving operations.

Moreover, by utilizing a hammerless connection, the articulating arms may further reduce the time requirements and the safety hazards. Relative to conventional systems, the pumping system disclosed herein may reduce the number of action steps, and consequently the time requirements and opportunities for injury, by as much as 60% or more. Accordingly, the present disclosure provides for a novel pumping system with advantages over conventional systems.

An embodiment of the present disclosure is a system for routing pressurized fluid from a fluid source. The system includes a composite articulating arm, which further includes a first articulating arm and a second articulating arm. The first articulating arm and second articulating arm are coupled via a connection. Further, the composite articulating arm includes no more than five elbows and six rotation points.

Optionally, the first articulating arm and second articulating arm are pre-assembled. Preferably, each of the first articulating arm and second articulating arm includes at least one swivel joint assembly, and each swivel joint assembly includes at least one elbow and at least one rotation point. Optionally, the first articulating arm includes two rotation points and two elbows, and the second articulating arm includes four rotation points and three elbows. Optionally, the first articulating arm includes four rotation points and three elbows, and the second articulating arm includes two rotation points and two elbows. Optionally, the first articulating arm includes three rotation points and three elbows, and the second articulating arm includes three rotation points and two elbows.

Preferably, the composite articulating arm of the system includes a first end and a second end. Preferably, an axis of a first elbow nearest the first end of the composite articulating arm is in substantially the same plane as a second elbow nearest the first end of the composite articulating arm, and an axis of a third elbow nearest the second end of the composite articulating arm is in a substantially parallel plane as the axes of the first and second elbow nearest the first end of the composite articulating arm.

Another embodiment of the present disclosure is a pumping system for routing pressurized fluid from a fluid source. The pumping system includes one or more pumping modules, and each of the pumping modules includes a pump and a pump interface. Each pump interface includes a composite articulating arm, which further includes a first articulating arm coupled to the pump and a second articulating arm coupled to a manifold system. The first articulating arm and second articulating arm are coupled via a connection. Further, the composite articulating arm includes no more than five elbows and six rotation points.

Optionally, the pumping module of the pumping system is configured as one of a mobile unit or stationary unit. Optionally, the manifold assembly is configured as one of a mobile unit or stationary unit. Optionally, the first articulating arm includes two rotation points and two elbows, and the second articulating arm includes four rotation points and three elbows. Optionally, the first articulating arm includes four rotation points and three elbows, and the second articulating arm includes two rotation points and two elbows. Optionally, the first articulating arm includes three rotation points and three elbows, and the second articulating arm includes three rotation points and two elbows.

Preferably, the composite articulating arm includes a first end and a second end. Preferably, an axis of a first elbow nearest the first end of the composite articulating arm is in substantially the same plane as a second elbow nearest the first end of the composite articulating arm, and an axis of a third elbow nearest the second end of the composite articulating arm is in a substantially parallel plane as the axes of the first and second elbow nearest the first end of the composite articulating arm.

Another embodiment of the present disclosure is a method of routing pressurized fluid from a fluid source. The method includes providing one or more pumping modules. Each of the pumping modules includes a pump and a pump interface. The pump interface further includes a composite articulating arm, which further includes a first articulating arm and a second articulating arm. Further, the composite articulating arm includes no more than five elbows and six rotation points. The method further includes providing a manifold system, which further includes a high-pressure main line and a low-pressure main line. The method further includes coupling the first articulating arm to the pump and the second articulating arm to the manifold system and coupling the first articulating arm to the second articulating arm. The method further includes routing a pressurized fluid from a fluid source via the composite articulating arm.

Optionally, one of the first articulating arm and second articulating arm is adjustable to extend toward or away from one of the manifold system and the pump. Preferably, the composite articulating arm includes a first end and a second end. Preferably, an axis of a first elbow nearest the first end of the composite articulating arm is in substantially the same plane as a second elbow nearest the first end of the composite articulating arm, and an axis of a third elbow nearest the second end of the composite articulating arm is in a substantially parallel plane as the axes of the first and second elbow nearest the first end of the composite articulating arm.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. The indefinite articles "a" or "an," as used in the claims, are defined herein to mean one or more than one of the element that it introduces. Also, the terms in the claims have their plain, ordinary meaning unless otherwise explicitly and clearly defined by the patentee.

What is claimed is:

1. A system for routing pressurized fluid from a fluid source, the system comprising:

a composite articulating arm comprising a first articulating arm and a second articulating arm, each of the first and second articulating arms comprising at least one elbow, at least one rotation point, and an extension, wherein at least one of the first articulating arm and the second articulating arm comprises an angle deviation;

wherein the extension of the first articulating arm and the extension of the second articulating arm are arranged to be coupled together via a connection such that when the first articulating arm and the second articulating arm are coupled together via the connection, the pressurized fluid can be routed from the fluid source;

a first swivel joint assembly coupled to one end of the extension of the first articulating arm;

a second swivel joint assembly coupled to one end of the extension of the second articulating arm; and wherein each of the first and second swivel joint assemblies comprise no more than five elbows and six rotation points.

2. The system of claim 1, wherein the first articulating arm and the second articulating arm are pre-assembled.

3. The system of claim 1, wherein each swivel joint assembly comprises at least one elbow and at least one rotation point.

4. The system of claim 1, wherein the first articulating arm comprises two rotation points and two elbows, and wherein the second articulating arm comprises four rotation points and three elbows.

5. The system of claim 1, wherein the first articulating arm comprises four rotation points and three elbows, and wherein the second articulating arm comprises two rotation points and two elbows.

6. The system of claim 1, wherein the first articulating arm comprises three rotation points and three elbows, and wherein the second articulating arm comprises three rotation points and two elbows.

7. The system of claim 1, wherein the composite articulating arm comprises a first end and a second end.

8. The system of claim 7, wherein an axis of a first elbow nearest the first end of the composite articulating arm is in substantially the same plane as a second elbow nearest the first end of the composite articulating arm, and wherein an axis of a third elbow nearest the second end of the composite articulating arm is in a substantially parallel plane as the axes of the first and second elbow nearest the first end of the composite articulating arm.

9. A pumping system for routing pressurized fluid from a fluid source, the pumping system comprising:

one or more pumping modules wherein each of the pumping modules comprises a pump and a pump interface;

wherein the pump interface comprises a composite articulating arm;

wherein the composite articulating arm comprises a first articulating arm coupled to the pump and a second articulating arm coupled to a manifold system, each of the first and second articulating arms comprising at least one elbow, at least one rotation point, and an extension, wherein at least one of the first articulating arm and the second articulating arm comprises an angle deviation;

wherein the extension of the first articulating arm and the extension of the second articulating arm are arranged to be coupled together via a connection such that when the first articulating arm is coupled to the second articulating arm via the connection, the pressurized fluid can be routed between the one or more pumping modules and the manifold system;

a first swivel joint assembly coupled to one end of the extension of the first articulating arm;

a second swivel joint assembly coupled to one end of the extension of the second articulating arm;

wherein each of the first and second swivel joint assemblies comprise no more than five elbows and six rotation points.

10. The pumping system of claim 9, wherein the pumping module is configured as one of a mobile unit or stationary unit.

11. The pumping system of claim 9, wherein the manifold assembly is configured as one of a mobile unit or stationary unit.

12. The pumping system of claim 9, wherein the first articulating arm comprises two rotation points and two elbows, and wherein the second articulating arm comprises four rotation points and three elbows.

13. The pumping system of claim 9, wherein the first articulating arm comprises four rotation points and three elbows, and wherein the second articulating arm comprises two rotation points and two elbows.

14. The pumping system of claim 9, wherein the first articulating arm comprises three rotation points and three elbows, and wherein the second articulating arm comprises three rotation points and two elbows.

15. The pumping system of claim 9, wherein the composite articulating arm comprises a first end and a second end.

16. The pumping system of claim 15, wherein an axis of a first elbow nearest the first end of the composite articulating arm is in substantially the same plane as a second elbow nearest the first end of the composite articulating arm, and wherein an axis of a third elbow nearest the second end of the composite articulating arm is in a substantially parallel plane as the axes of the first and second elbow nearest the first end of the composite articulating arm.

17. A method of routing pressurized fluid from a fluid source, the method comprising:

providing one or more pumping modules, wherein each of the pumping modules comprises a pump and a pump interface;

wherein the pump interface comprises a composite articulating arm;

wherein the composite articulating arm comprises a first articulating arm and a second articulating arm that are arranged to be coupled to each other via a connection, each of the first and second articulating arms comprising at least one elbow, at least one rotation point, and an extension, wherein at least one of the first articulating arm and the second articulating arm comprises an angle deviation;

a first swivel joint assembly coupled to one end of the extension of the first articulating arm;

a second swivel joint assembly coupled to one end of the extension of the second articulating arm;

wherein each of the first and second swivel joint assemblies comprise no more than five elbows and six rotation points;

providing a manifold system comprising a high-pressure main line and a low-pressure main line;

coupling the first articulating arm to the pump and the second articulating arm to the manifold system;

coupling the extension of the first articulating arm to the extension of the second articulating arm via the connection; and routing a pressurized fluid from a fluid source via the composite articulating arm.

18. The method of claim 17, wherein one of the first articulating arm and second articulating arm is adjustable to extend toward or away from one of the manifold system and the pump.

19. The method of claim 17, wherein the composite articulating arm comprises a first end and a second end, and wherein an axis of a first elbow nearest the first end of the composite articulating arm is in substantially the same plane as a second elbow nearest the first end of the composite articulating arm, and wherein an axis of a third elbow nearest the second end of the composite articulating arm is in a substantially parallel plane as the axes of the first and second elbow nearest the first end of the composite articulating arm.

* * * * *